United States Patent [19]

Fuss

[11] Patent Number: 4,815,776

[45] Date of Patent: Mar. 28, 1989

[54] ELECTRIC DOOR OPENER

[75] Inventor: Fritz H. Fuss, Albstadt, Fed. Rep. of Germany

[73] Assignee: Fritz Fuss KG, Albstadt, Fed. Rep. of Germany

[21] Appl. No.: 44,536

[22] Filed: May 1, 1987

[30] Foreign Application Priority Data

Feb. 23, 1987 [EP] European Pat. Off. ..... 87102536

[51] Int. Cl.[4] ..... E05B 47/00

[52] U.S. Cl. ..... 292/341.16

[58] Field of Search ..... 292/341.16, 341.17, 292/201, 144

[56] References Cited

U.S. PATENT DOCUMENTS 3,819,215 6/1974 Fuss ..... 292/341.16 X 4,211,443 7/1980 Butts et al. ..... 292/341.16

*Primary Examiner*—Richard E. Moore

*Attorney, Agent, or Firm*—Beveridge, DeGrandi & Weilacher

[57] ABSTRACT

An electric door opener with a changer freeing or blocking a latch is described, which changer is detachably engaged with an electromagnetically operable inner armature. An electromagnetically controllable locking device prevents disengagement of the inner armature from the changer, e.g. as a result of an impact. The locking device has a locking lever provided with a detent and a control edge. The lever engages a corresponding projection on the inner armature. An outer armature acting on the control edge initially deflects the locking lever to overcome the locking action and, after a predetermined forward movement, drives the inner armature to release the changer.

12 Claims, 2 Drawing Sheets

ELECTRIC DOOR OPENER

BACKGROUND OF THE INVENTION

The present invention relates to an electric door opener with a coil assembly which acts on a resiliently biased inner and outer armature and with a changer engaging with the inner armature for locking a door opener latch.

Such electric door openers are generally known, it being possible to distinguish between an operating current design and a closed circuit current design. Fundamentally, the function of such a door opener is based on the fact that the changer is kept in the swinging region of the door opener latch by the inner armature until the inner armature releases the latch by operation of the coil assembly, the changer then being move out of the swinging region of the door opener latch with the aid of a changer spring. In the operating current design type the inner armature is operated by supplying current to the coil assembly to oppose the bias of the armature spring, whereas a door opener of the closed circuit current design type can only be opened when power is disconnected.

Although such electric door openers operate extremely reliably and securely, in special circumstances during an impact-like force, the inner armature will be disengaged from the changer and the latch will be released.

SUMMARY OF THE INVENTION

The problem addressed by the present invention is to provide an electric door opener of the aforementioned type, which is better secured against momentary opening as a result of an impact.

This problem is solved in that the inner armature is under bias transmitted by an outer armature which is operated by the coil assembly to detachably hold the inner armature in a secure position relative to the changer.

The invention has the advantage that the inner armature and changer are automatically locked together as a result of resilient pretension so that the inner armature reliably will be prevented from jumping up even in the case of an impact. Unlocking takes place by means of the coil assembly on correctly releasing the inner armature in an authorized manner. If, for example, in the case of an operating current door opener the coil assembly is supplied with current, then the safety bolt or catch of the inner armature is released and after release has taken place, the inner armature is also disengaged from the changer through the coil assembly.

According to a preferred development of the invention, there is a locking lever mounted in a swinging axis and whose free end is provided with a projection, which projection is in detachable engagement with a corresponding detent edge on the inner armature. The locking lever has a control edge engaged with a control lever operable by the coil assembly in such a way that on moving the control lever along the control edge, the locking lever is deflected for releasing the inner armature.

The advantage of this construction is that the locking of the inner armature can be implemented with a very small number of components and that a space-saving arrangement is possible.

According to a particularly simple further development, the outer armature serves as the control lever and with respect to the inner armature, the outer armature has a given floating position for precontrolling the locking lever, which makes it unnecessary to construct a separate control lever.

In a preferred embodiment, the floating position of the outer armature is provided because the outer armature and inner armature are interconnected by means of a driver which has a corresponding clearance.

It can also be advantageous for economizing on components if the locking lever is mounted on the swinging axis of the changer.

It can be advantageous with a view to a possibly necessary adjustment of the locking device for the detent edge of the inner armature to comprise a sheet metal part having an elongated hole and screwed to the inner armature. Adjustment is carried out by moving the sheet metal part along the elongated hole.

According to an advantageous further development, the sheet metal part is provided with a tongue engaging over the free end of the locking lever for the guidance of the latter. This ensures a reliable guidance of the locking lever to prevent the free end of the securing lever with the detent edge from being deflected at right angles to the swinging movement and thus becoming disengaged from the detent in an uncontrolled manner.

The pretensioning of the locking lever in the direction of the detent of the inner armature is preferably achieved by a compression spring provided between the securing lever and one casing wall of the door opener.

It can also be advantageous for the inner armature to be held in its swinging direction at a given distance from the free end of the changer with the aid of a spacer supported on the casing. This measure eliminates any thrust transfer to the inner armature in the longitudinal direction of the changer.

BRIEF DESCRIPTION OF THE DRAWINGS

The invention is described in greater detail hereinafter with respect to to a non-limitative embodiment and the attached drawings, wherein.

DETAILED DESCRIPTION OF THE INVENTION

Figure 1:
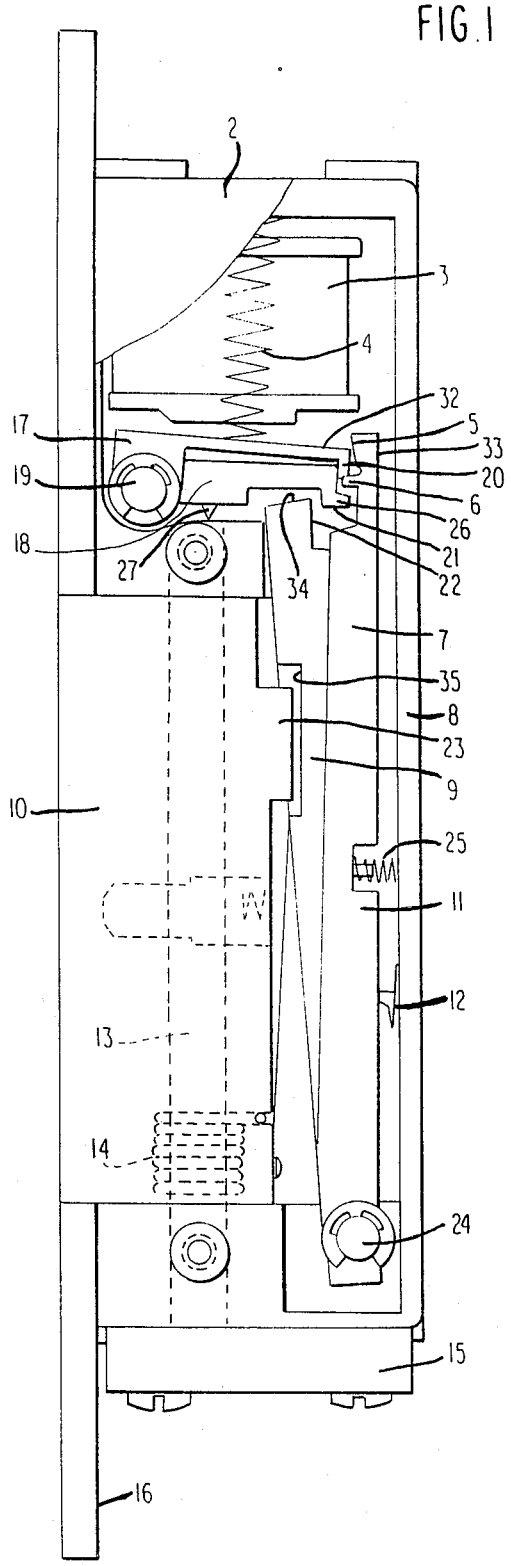
FIG. 1 is a side view of an electric door opener according to the present invention with the casing cover removed, and is an enlarged view of a portion of an alternative embodiment according to the present invention.

FIG. 1 shows an embodiment of an electric door opener according to the present invention in side view, in which the casing cover 2 is largely removed, so that it is possible to see the components. A coil assembly 3 which can be supplied with power across terminals 15 acts on an outer armature 17 and an inner armature 18, which are both located on a common spindle 19 so as to permit them to swing. With respect to inner armature 18, outer armature 17 has a given floating position so that when power is supplied to the coil assembly 3, initially, only the outer armature is attracted and only after passing through the floating position, is the inner armature 18 driven by the outer armature 17. This is brought about in the represented embodiment by a hook-shaped driver 20 on the free end 32 of outer armature 17, which driver 20 engages below the free end 33 of inner armature 18. Outer armature 17 is loaded by an armature spring 4. Inner armature 18 is provided with a detent 21 for engaging with a detent edge 22 of a changer 9 which serves to block or release a door opener latch 10. If inner armature 18 is swung outwards by outer armature 17, then edge 22 is disengaged from detent 21 and changer 9 is released. In this state, the door opener latch 10 can be pivoted about its axis 13 so that the changer 9 is forced away by a projection 23 on door opener latch 10 which contacts a recessed portion 35 of the changer to move the changer counter to the tension of a changer spring 12. Changer 9 then swings about a changer spindle 24. However, if the detent edge 22 has engaged on inner armature 18, then changer 9 is in the swinging region of projection 23 and prevents the door opener latch 10 from opening. Following each movement, this is moved back into the initial position by a latch spring 14 and in this position it terminates flush with a closing plate 16 in the represented embodiment.

FIG. 1 illustrates the state of the electric door opener in which changer 9 is engaged on inner armature 18, and inner armature 18 is locked by means of a locking lever 7. As will be explained in greater detail hereinafter, the inner armature 18 is released by means of the coil assembly 3. In the absence of power supplied to coil assembly 3, it is not possible to stop the blocking action of changer 9.

In the represented embodiment locking lever 7 is constructed as a flat sheet metal part which is arranged on the changer spindle 24 in such a way that it can be swung. In addition, locking lever 7 is biased by means of a compression spring 25 which is supported on a casing wall 8. The swinging movement of locking lever 7 is perpendicular to the longitudinal axis of inner armature 18. In the locked state, a projection 6 on locking lever 7 engages behind a corresponding projection or edge 26 on inner armature 18 which is shown purely diagrammatically in FIG. 1. If the locking lever 7 is swung outwards, then it releases the inner armature 18.

Locking lever 7 is released by means of a control edge 5 which is in engagement with outer armature 17. If outer armature 17 is swung, then its free end 32 slides along control edge 5, which in this case is formed by a wedge-shaped or bevelled configuration of the free end 33 of locking lever 7 and in this way brings about a deflection of said lever 7.

FIG. 1 also illustrates that the inner armature 18 is kept at a predetermined distance from the end face 34 of changer 9 by means of a spacer 27 which is supported on a door opener casing. This measure prevents any transfer of momentum from changer 9 to inner armature 18 in the longitudinal direction of the changer, e.g. in the case of an impact. This may also relieve the inner armature locking system.

Figure 2:
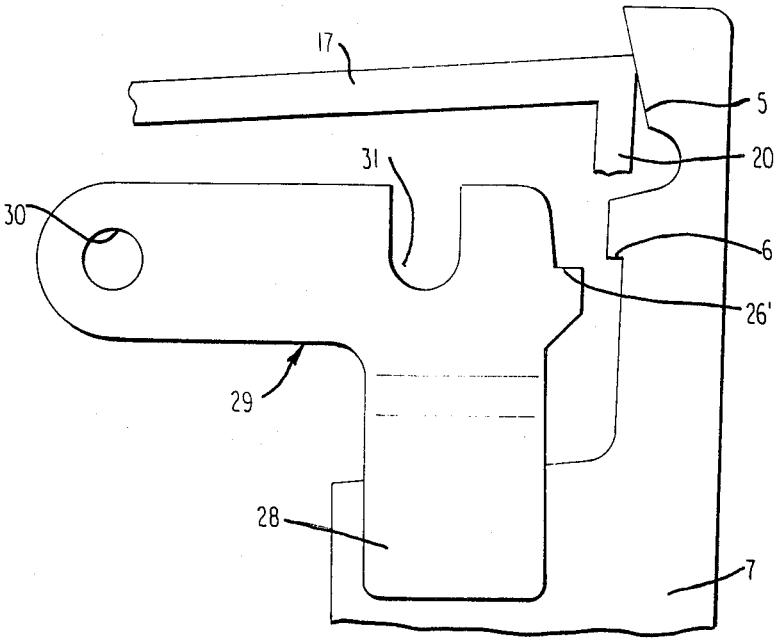

FIG. 2 shows a portion of an alternate embodiment of invention which also aids in understanding the way in which the inner armature (not shown in FIG. 2) can be locked. The same parts shown in FIG. 1 are given the same reference numerals in FIG. 2. Unlike in FIG. 1 the projection or edge 26′ cooperating with the projection 6 of locking lever 7 is formed on a sheet metal cover plate 29, which is fitted to the inner armature (not shown). Cover plate 29 is provided with an opening 30 and an elongated hole 31 for enabling fixing and adjusting of the plate 29 on the inner armature. With the aid of a bolt (not shown) through opening 30 and the inner armature (not shown), the cover plate 29 is first arranged in swingable manner on the inner armature, a deflection being possible for adjustment purposes by means of elongated hole 31. The cover plate 29 is secured by a bolt (not shown) through the elongated hole 31 for fixing the plate to the inner armature.

Cover plate 29 also has a tongue 28, which engages over locking lever 7 in such a way that it is precisely guided between tongue 28 and the underlying inner armature and any giving way on the part of the locking lever at right angles to the drawing plane is prevented.

FIG. 2 illustrates the state in which the outer armature 17 is attracted by the coil assembly. As a result of attraction by the coil assembly, the free end 32 of the outer armature 17 engages the control edge 5 and locking lever 7 is swung outwards and is disengaged from edge 26′.

Thus, the inner armature (not shown) is released and by means of driver 20 can be disengaged from the changer. So as not to overburden the representation, these parts are not shown in FIG. 2.

What is claimed is:

1. An electric door opener comprising:

latch means movable between a door-releasing and a door-locked position;

pivotable changer means;

inner means engageable with said changer means to lock said changer means in a position preventing movement of said latch means from its door-locked to its door-release position;

biasing means;

coil means;

outer means for alternatively transmitting biasing force produced by said biasing means to said inner means to cause said inner means to engage said changer means and transmitting force produced by said coil means to oppose said biasing force and cause said inner means to disengage from said changer means.

2. A door opener as claimed in claim 1, wherein said inner means has a contact edge, said outer means is provided in the form of a control lever pivotably movable from a first position for transmitting said biasing force to said inner means through a second, floating position to a third position for transmitting said opposing force to said inner means, said control lever has a contacting portion, and said door opener further comprises a pivotable locking lever having a free end provided with a projection detachably engageable with said contact edge of said inner means, and a control edge adapted for engagement with said contacting portion of said control lever when said control lever is in said floating position, said contacting portion engaging said control edge of said locking lever to pivotally move said lever and release said inner means.

3. A door opener as claimed in claim 2, wherein said control lever comprises a driver for providing said floating position, said driver being spaced-apart from said inner means when said control lever is in said first position.

4. A door opener as claimed in claim 2, wherein said locking lever and said changer have a common spindle.

5. A door opener as claimed in claim 2, wherein said inner means comprises a pivotable member and plate means secured to said pivotable member, said plate means providing said contact edge, said plate means having a groove therein.

6. A door opener as claimed in claim 5, wherein said plate means has a tongue portion.

7. A door opener as claimed in claim 2, comprising a casing wall and a compression spring disposed between said wall and said locking lever for biasing said locking lever towards engagement with said inner means.

8. A door opener as claimed in claim 1, furthr comprising spacer means for maintaining a portion of said inner means a predetermined distance apart from a free end of said changer means in a direction along the longitudinal axis of said changer means.

9. An electric door opener comprising:

latch means movable between a door-releasing and a door-locked position;

changer means;

pivotable inner means engageable with said changer means to lock said changer means in a position preventing movement of said latch means from its door-locked to its door-release position;

biasing means for biasing said inner means to cause said inner means to engage said changer means;

coil means for providing force influencing said inner means in opposition to said biasing means to cause said inner means to disengage from said changer means; and spacer means for maintaining a portion of said inner means a predetermined distance apart from a free end of said changer means in a direction along the longitudinal axis of said changer means.

10. A door opener as claimed in claim 9, further comprising pivotable outer means disposed between said biasing means and said inner means and between said coil means and said inner means for transmitting said biasing and said opposing forces to said inner means.

11. A door opener as claimed in claim 10, wherein said inner means has a contact edge, said outer means is provided in the form of a control lever pivotably movable from a first position for transmitting said biasing force to said inner means through a second, floating position to a third position for transmitting said opposing force to said inner means, said control lever has a contacting portion and said door opener further comprises a pivotable locking lever having a free end provided with a projection detachably engageable with said contact edge of said inner means, and a control edge adapted for engagement with said contacting portion of said control lever when said control lever is in said floating position, said contacting portion engaging said control edge of said locking lever to pivotally move said lever and release said inner means.

12. A door opener as claimed in claim 11, wherein said control lever comprises a driver for providing said floating position, said driver being spaced apart from said inner means when said control lever is in said first position.

* * * * *